United States Patent [19]

McGregor et al.

[11] 4,425,853

[45] Jan. 17, 1984

[54] CASH SAFE

[76] Inventors: Jon D. C. McGregor; Deanna E. Richards, both of 3/52 Grange Rd., Toorak, Australia, 3142

[21] Appl. No.: 279,963

[22] PCT Filed: Oct. 31, 1980

[86] PCT No.: PCT/AU80/00082

§ 371 Date: Jun. 26, 1981

§ 102(e) Date: Jun. 26, 1981

[87] PCT Pub. No.: WO81/01325

PCT Pub. Date: May 14, 1981

[30] Foreign Application Priority Data

Oct. 31, 1979 [AU] Australia ..... PE1145
Oct. 31, 1979 [AU] Australia ..... PE-1151

[51] Int. Cl.[3] ..... E05G 1/12; E05B 43/00

[52] U.S. Cl. ..... 109/25; 109/43; 109/59 R; 70/267; 70/273

[58] Field of Search ..... 109/1, 23, 25, 29, 43, 109/64, 66, 59 R; 70/267, 268, 269, 273, 272

[56] References Cited

U.S. PATENT DOCUMENTS

| | | | |
|---|---|---|---|
| 199,567 | 1/1898 | Paige | 70/268 |
| 894,180 | 7/1908 | Blechschmidt | 70/267 |
| 1,722,071 | 7/1929 | Benham | 70/273 |
| 1,813,441 | 7/1931 | Diesel | 70/273 |
| 2,140,698 | 12/1938 | Goehring | 70/268 |
| 2,789,426 | 4/1957 | Hollins | 70/267 |
| 3,119,248 | 1/1964 | Kaminsky | 70/272 |
| 4,062,303 | 12/1977 | Fegley | 109/29 |

FOREIGN PATENT DOCUMENTS

| | | | |
|---|---|---|---|
| 285529 | 4/1969 | Australia | 109/29 |

*Primary Examiner*—Gene Mancene
*Assistant Examiner*—David I. Tarnoff
*Attorney, Agent, or Firm*—Holman & Stern

[57] ABSTRACT

A cash safe having a receptacle to hold cash inserted through a slot, an opening for removal of cash from the receptacle, a closure positionable to cover the opening, a locking device for locking the closure in position, and a clockwork timer operable on actuation of the locking device to prevent the locking device from being deactuated for a time period. The cash safe in one embodiment is arranged for actuation of the locking device by turning a knob which also winds up the clockwork timer. A key lock is operable to latch the timer so that operation of the timer to begin the time period is inhibited until release of the key lock. In another embodiment a key lock actuates the locking device and at the same time winds up the timer which inhibits timing by the timer of the time period until the key lock is moved to a condition for opening the safe. Provision is also made for actuation of a marker device to mark the contents of the safe when the safe is removed from a surface on which it rests.

16 Claims, 12 Drawing Figures

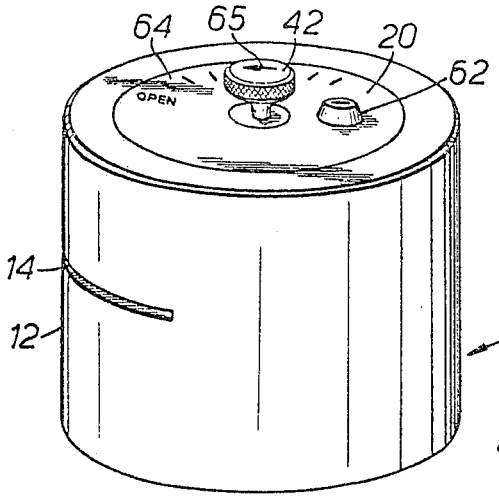
FIG. 1.
FIG. 4.
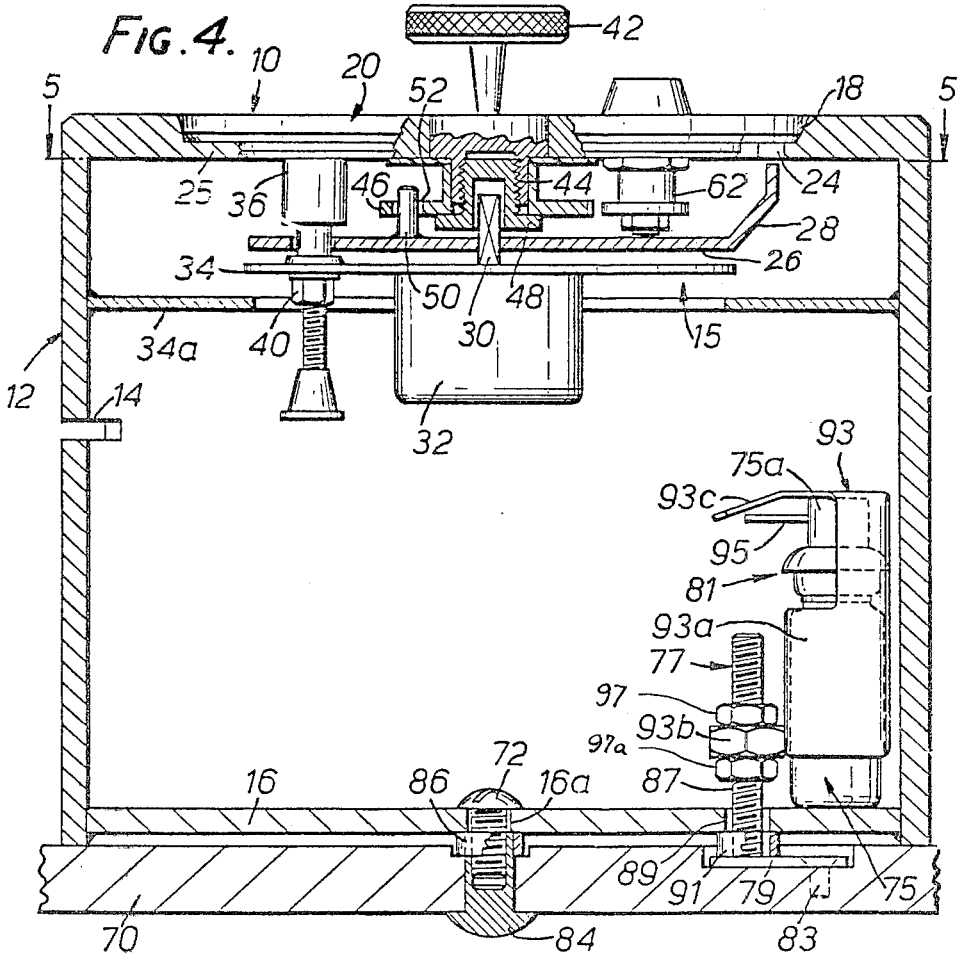

CASH SAFE

SUMMARY OF THE INVENTION

According to one aspect of the present invention there is provided a cash safe comprising a receptacle to retain articles and having an opening for at least removal of said cash from the receptacle, a closure positionable on said receptacle to close said opening, locking means actuatable to effect locking of said closure over said opening and deactuable to release said locking: characterised in that said locking means is provided with timing means operating, on effecting said actuation of said lock means, to preclude said deactuation for a time period after said actuation.

Preferably, said timing means operates to deactuate said locking means automatically after said time period, said time period may be pre-selectable. Preferably too, means may be provided selectively operable to inhibit operation of said timing means and being further operable to release said inhibition and restore the timing means to operation.

The locking means may comprise a locking member rotatable at a pre-determined rate under influence of said timing means to move the locking member from an actuated rotational position assumed pursuant to said actuation, to a deactuated rotational position, said locking member co-operating with an abutment on the receptacle, when at a rotational position other than said deactuated position, to effect said locking, and, when at said deactuated position, effecting said release of said locking.

The timing means preferably comprises a timer actuated by rotation of an actuating member in a pre-determined direction to a pre-determined extent, and subsequently operating to rotate said actuating member in the direction against said pre-determined direction at said pre-determined rate whereby the said time period is dependant upon the said pre-determined extent to which the said actuating member was rotated.

Preferably, the closure includes a setting member projecting from that side of said closure which is external to the cash safe when the closure is in position over said opening and which is operable to effect said movement of said actuating member to said pre-determined extent.

Preferably, the setting member is interconnected with said locking member by a lost motion linkage whereby movement of said setting member in a first rotational direction from a rest position causes said locking member to be moved from said deactuated position to a said actuated position, but such that the setting member cannot by subsequent movement thereof be caused to move the locking member in the direction towards said deactuated position. Preferably, said lost motion linkage comprises a rotatable member mounted for rotation together with said setting member and having a first abutment positioned to engage a second abutment on said locking member for imparting movement of the locking member from the setting member in a direction for moving the locking member away from said deactuated position, but which first abutment is cleared from engagement with the second abutment under reverse rotational movement of the setting member.

Preferably, the cash safe is arranged to permit latching of the locking member, once positioned at an actuated position, to inhibit operation of said timing means, and rotation of the locking member back to said deactuated position. Thus, a latch member may be provided operable to engage said rotatable member to effect latching thereof against rotation whereby to preclude rotation of the locking member back towards said deactuated position by engagement between said first and second abutments. Said latch member may be operable by a key actuatable device on said closure and accessible to actuation when the closure member is positioned on said opening. More particularly, the rotatable member may be in the form of a disc with a toothed peripheral portion disposed such that the latching member can be moved, by operating the said key actuatable device, to engage teeth on said toothed peripheral portion to effect said latching.

The said locking member may have one or more outwardly extending projections and said abutment on said receptacle may comprise a radially inwardly extending ledge around said opening with openings therein aligned with respective ones of the said outwardly extending projections when the locking member is in its deactuated position. Preferably too, the said closure is provided with means cooperating with further means on the receptacle to preclude rotation thereof relative to the said ledge, and these means may, comprise abutments on the said closure together with the said openings in the said ledge, the said abutments on the closure being positioned to engage into the latter openings when the closure is positioned over said opening. Alternatively, the ledge and closure may, of course, simply be formed of non-circular form, for precluding such relative rotation.

The cash safe is normally provided with an opening in said receptacle for admission of said cash thereinto, but being dimensioned such as to at least substantially preclude removal of said cash. The last mentioned opening may be in the form of a slot.

In accordance with another aspect of the invention there is provided a cash safe securable to a bench top or other rigid member; characterized by the provision of a marker device operable to mark the contents of the cash safe on the removal of the cash safe from said rigid member. More particularly, said marker device may be within the cash safe and preferably comprises first and second parts arranged to be positioned on either side of a receptacle containing dye material for effecting said marking, one said part being movable relative to the other and having a portion extending in use through an opening in a base of the cash safe and, in use, secured to said rigid member, said one part being arranged whereby in use, when positioned to be secured to said rigid member, removal of the cash safe from said rigid member causes said one part to be moved relative to said other part whereby to effect pressing a said receptacle between said parts, said receptacle being of a kind operable to release said dye material on said pressing.

BRIEF DESCRIPTION OF THE DRAWINGS

The invention will now be further described with reference to the accompanying drawings in which:

FIG. 1 is a perspective view of a cash safe constructed in accordance with the invention;

FIG. 4 is a cross-sectional view taken through the central vertical axis of FIG. 1;

DETAILED DESCRIPTION

Figure 2:
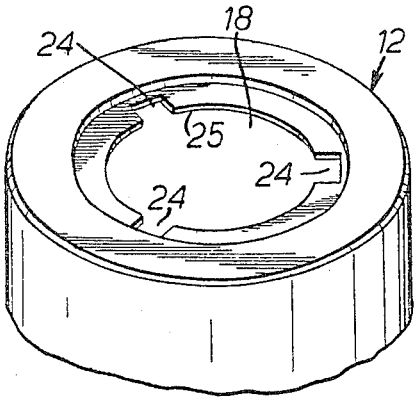
FIG. 2 is a fragmentary perspective view showing an opening in a receptacle portion of the cash safe in FIG. 1.
Figure 3:
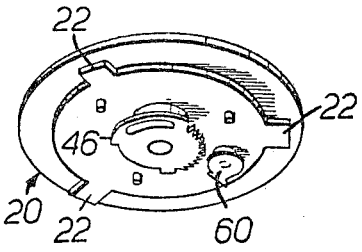
FIG. 3 is an under-side perspective view of a closure forming part of the cash safe of FIG. 1.

The cash safe 10 shown in FIG. 1 comprises a generally cylindrical receptacle 12 having a slot 14 therein for admission of money into the interior of the receptacle. The receptacle 12 is closed at its base by a generally circular plate 16 but has a circular top opening 18 (FIG. 4 for example) for removal of money from the interior of the receptacle. A removable closure 20 is provided fittable to opening 18 to close this off so that removal of money from the interior of the receptacle can be achieved only through the slot 14. As best shown in FIG. 3, closure 20 has a portion of its peripheral underside removed in such a fashion as to define three equally spaced downwardly projecting abutments 22. The mouth of opening 18 is provided with a peripheral ledge 25 cut away at three places to define three equally spaced openings 24 in the ledge. When the closure 20 is in position on opening 18, the abutments 22 register with the openings 24 to preclude relative rotation between the closure and the receptacle 12.

Figure 5:
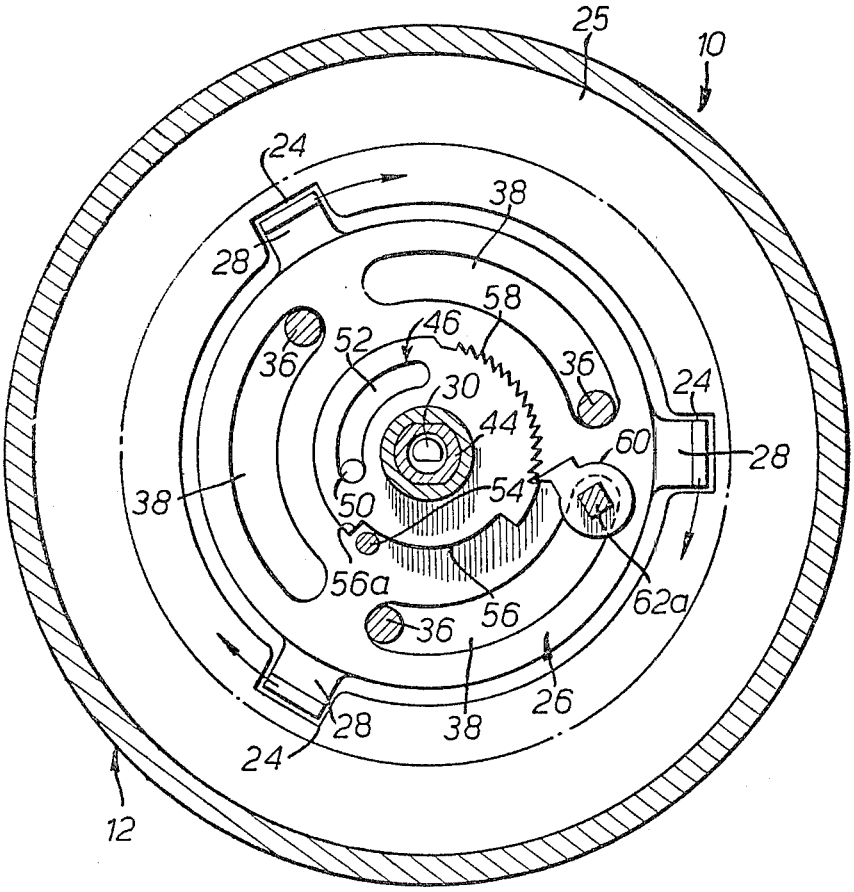
FIG. 5 is a cross-sectional view taken substantially on the line 5—5 in FIG. 4.

The cash safe includes a locking means 15. When the closure 20 is in position on receptacle 12 to close opening 18, a locking member 26 of means 15 is operable to underly ledge 25 in such a manner as to preclude removal of the cover 20 from the opening 18. The locking member 26 is best shown in FIG. 5, being circular in form with three equiangularly spaced outwardly extending projections 28 arranged on the periphery. Projections 28 are so dimensioned and positioned as to be alignable by relative rotation of the locking member 26, in a manner described later, to underly perspective ones of the abutments 22 to permit the projections 28 to pass through the openings 24 in ledge 25 during positioning of the closure 20 over opening 18. After such positioning, member 26 is rotatable so that the projections 28 underly the ledge 25 to preclude removal of the closure 20 from the opening 18.

The locking member 26 is carried by and is rotatable with the output shaft 30 of a timing device 32. Timing device 32 is carried by a circular plate 34 co-axially positioned in spaced apart relationship below closure 20. More particularly, three bolts 36 extend downwardly from the underside of closure 20 through elongate slots 38 in locking member 26 and thence through openings in plate 34. Nuts 40 are threadedly received on the ends of bolts 36 so that, by co-operation between these nuts and inwardly stepped peripheral proportions of the bolts 36, the plate 34 is rigidly secured to the bolts 36. The slots 38 are so formed and positioned as to permit a limited degree of relative rotation between the closure 20 and the locking member 26.

A setting member in the form of an actuating knob 42 is provided on the exterior surface of closure 20, this being connected to a shaft 44 co-axially mounted relative to the closure 20 and the shaft 30. Shaft 44 extends from the underside of the closure 20 towards plate 34. Shaft 44 has mounted thereon a rotatable member in the form of a clutch plate 46, this being non-rotatably received on the shaft 44 and locked into position thereon by a threaded insert member 48 which is threadedly received on an internally threaded bore at the lower end of shaft 44 and has outwardly extending flange portions which preclude movement of the clutch plate 46 on the shaft 44 in the direction away from closure 20.

Figure 6:
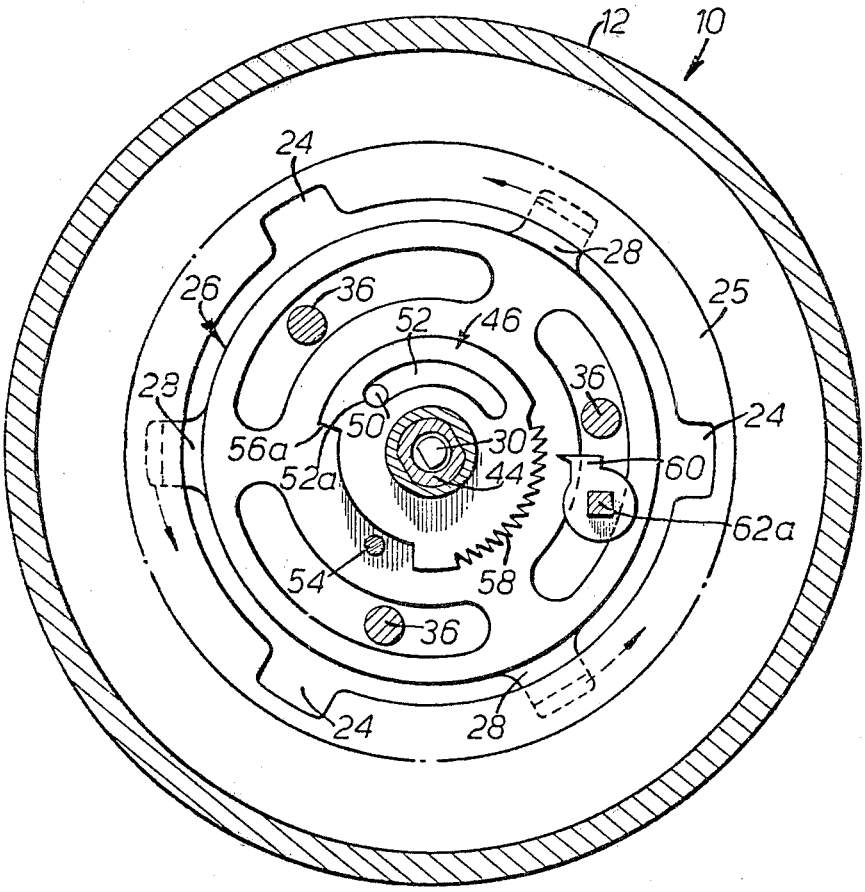
FIG. 6 is a cross-section view similar to FIG. 5 but showing parts of the cash safe in a different position.

Locking member 26 has an upstanding pin 50 thereon which is received in an acuate slot 52 in plate 46. The position of the slot 52 and pin 50 as shown in FIG. 5 is a rest position of each of these components at which the knob 42 is in a rest position and the locking member 26 is at a "deactuated" position corresponding to a position where the projections 28 underlie the projections 22. That is to say, in the deactuated position, the closure 20 can be removed from the opening 18 by virtue of the aforementioned alignment of the projections 28 and abutments 22. By rotating knob 42 away from the rest position in one direction, being a clockwise direction as viewed in FIG. 5, the clutch plate 46 is rotated in this direction, so that the pin 50 is immediately engaged by the extreme anti-clockwise end 52*a* of the slot 52 to cause corresponding rotation of the locking member 26 in the clockwise direction. Pursuant to this movement, then, the locking member 26 is moved from its deactuated position to an "actuated" position at which the projections 28 underlie ledge 25 as previously described in a manner precluding removal of the closure 20 from the opening 18 (FIG. 6). Once this movement has been effected by operation of knob 42 it is not possible to revert the locking member 26 to the deactuated position by reverse operation of the knob. That is to say, the co-operative abutments defined by the end 52*a* of slot 52 and the pin 50 form a lost motion linkage such that any such reverse operation of the knob 42 will cause movement of the clutch plate 46 in the counter-clockwise direction as viewed in FIG. 6 so that the slot 52 simply moves over the pin 50 with no driving interconnection between these parts. In order to limit the movement of the knob 42 in the counter-clockwise direction to an extent such that the extreme clockwise end of the slot 52 does not engage the pin 50, a pin 54 is provided on closure 20. This pin 54 extends downwardly from closure 20 and is arranged to move in an arcuate cut-out portion 56 in the periphery of plate 46, this cut-out portion having a radial end surface 56*a* positioned to just engage the pin 54 at the position of the clutch plate 46 corresponding to the rest position of knob 42.

The timer device 32 is a clockwork timer of known construction being of the kind which is operable for turning the shaft 30 in one direction to wind a clockwork mechanism within the timer 32 so that, upon release of the shaft 30 it will be returned to its initial position by reverse rotation under influence of the clockwork mechanism of the timer. This return movement takes place at a predetermined rate so that the time taken for the shaft 30 to revert to its initial position depends on the degree of initial rotation thereof. Thus, the effect of the turning of the member 26 away from its deactuated position to an actuated position corresponding to the degree of rotation of the knob 42 is to cause a correspondingly proportionate movement of the shaft 30. Since shaft 30 is attached to the member 26, there is thus effected a winding of the mechanism of timer device 32. Subsequently, the timer device 32 operates under influence of its clockwork mechanism to turn the shaft 30 in reverse direction to rotate the member 26 so that, after a pre-determined time proportional to the extent to which knob 42 was initially rotated, the locking member 26 is reverted to its deactuated position from which the closure 20 can be removed from opening 18. Under such rotation in the reverse direction, the clutch plate 46 is correspondingly rotated in the reverse direction and the knob 42 is also moved in the reverse direction to bring it back to its rest position.

The clutch plate 46 has a toothed peripheral portion 58 and a latching member 60 is provided on the underside of closure 20 such as to be rotatable from a position (FIG. 5) at which it engages between adjacent teeth on portion 58 to latch plate 46 to a position (FIG. 6) at which it is cleared from such engagement to permit rotation of plate 46. Latching member 60 is carried on the operating shaft 62*a* of a key actuated latching device 62 positioned on closure 20 so as to be operable by a key from the exterior of the closure 20. Latching device 20 may be in the form, for example, of a cylinder lock of known construction.

By use of the key, it is possible to operate latching device 62 in a manner to cause latching member 60 to engage peripheral portion 58 of clutch plate 46 at any rotational position of the clutch plate 46 which this assumes during operation of the cash safe. Thus, such latching will cause inhibition of operation of the timer device 32 since, by this means, the consequent latching of the clutch plate 46 will cause latching of the locking member 26, by virtue of engagement of the pin 50 with the extreme counter-clockwise end of slot 52, and thus holding of the shaft 30 of the timer device 32. On release of the latching member from engagement with peripheral portion 58, by key operation of the latching device 62, rotation of the shaft 30 is again permitted so that uninhibited operation of the timer device 32 ensues.

In use, closure 20 is positioned on opening 18 and knob 42 moved from its rest position through a predetermined rotational extent corresponding to a desired time period for deactuation. In order to assist in accurate setting of the knob 42, the closure 20 has on its exterior surface a plurality of marks 64 positioned about the periphery of the knob 42 these being selectively alignable with a reference mark 65 on the knob 42 to indicate the extent to which the knob 42 has been rotated. After such operation, it is not possible to gain access to the interior of the cash safe through the opening 18 until after elapse of the pre-determined time as set in accordance with the degree of initial rotation of the knob 42. This extent of rotation is thus representative of a minimum time which is necessary after such operation of the knob to permit access. The time can, however, be increased by operating the device 62 by its key to latch the member 46. In this case, the pre-determined time for opening will run from the time at which a subsequent deactuation of the device 62 occurs by use of the key.

The described cash safe is intended for use in any location at which money or valuables need to be protected, for instance in stores or the like. Thus, the cash safe may be bolted to a bench top 70 by use of a bolt 72 extending downwardly through a central opening 16*a* in plate 16 and into an internally threaded bolt member 84 extending upwardly from the underside of the bench top 70. A hardened steel collar 86 is provided around the exterior of bolt 84 between plate 16 and bench top 70 in order to make it more difficult for a person to saw through bolt 72 or bolt member 84 to effect removal of the cash safe from top 70. At the beginning of the day, then, the described cash safe construction permits a store-keeper to set the knob 42 to a desired minimum opening time, and latch operation of the timer device 32 by operation of device 62 so that, if a person should attempt to rob his store during the course of the day, it is not possible to immediately open the cash safe and the attempted robbery may be thwarted by inability of the intended robber to gain access immediately to the interior of the cash safe. Towards the end of the day, the store keeper may simply deactuate the latching device by use of its key at a time before closing time equal to the time initially set by operation of knob 42. Thus the cash safe will be opened at the time of closing of business.

In order to provide further protection against robbers, the cash safe 10 is fitted with a marker device 81 operable, on prying of the cash safe away from bench top 70, to act on a pressurized container 75 such as to cause expressment from the container of marker dye into the interior of the cash safe. Thus, if a robber should take possession of the entire cash safe 10, the contents thereof will be marked by the dye from container 75 to facilitate tracing thereof by law enforcement agencies.

Device 81 includes a member 77 made up of a plate 79, which in use is secured by screws 83 to the bench top, and an upright, threaded shank 87 welded to the plate 79 and extending upwardly from the plate 79 through an opening 89 in the base plate 16 to the interior of the receptacle 12. A hardened metal collar 91 is positioned around shank 87 where this extends between plate 79 and base plate 16 to make sawing through the shank 87 at this location difficult.

Device 81 also includes an upright container holder 93. This is in the form of a hollow cylindrical body 93*a* which has an apertured lug 93*b* secured to extend from one side thereof. Shank 87 passes through the aperture in lug 93*b* and lock nuts 97, 97*a* are threadedly received on shank 87 one to either side of lug 93*b* and tightened against the lug to hold the lug and holder 93 firmly to shank 87.

Container 75 is of a cylindrical form and is neatly but slidably accommodated within body 93*a* of holder 93, with the base of the container resting on the upper surface of base plate 16. The upper end of container 75 is fitted with an axially movable valve 75*a* which is normally resiliently biased away from the base of the container to a closed condition.

The valve is however movable, against such bias, towards the base and to an open condition at which pressurised dye within the container can pass outwardly of the container through an outlet 95 in the valve 75*a*. Holder 93 has an extension 93*c* which extends upwardly from body 93*a* and thence transversely across the upper end of the holder immediately above valve 75*a*. When an attempt is made to pry the safe 10 from bench top 70, the member 77 and holder 93 remain secured in fixed relation relative to the bench top. However as the base plate 16 is lifted from the bench top, the container 75, which rests on the base plate, is likewise lifted, pressing the valve 75*a* into engagement with the extension 93*c* to effect operation of the valve 75*a*.

The slot 14 through which money or the like is passed into the interior of the cash safe is preferably made equal to the minimum size necessary to permit insertion of money thereinto. Since it may be possible to interfere with the working of the locking mechanism of the cash safe by manipulation of a wire or the like passed through the slot 14, the cash safe is constructed so as to form a barrier against such interference. More particularly, an internal peripheral flange 34*a* is provided on the interior of the receptacle 12 this being arranged in a position so as to co-operate with the plate 34 such that the plate 34 extends over and substantially closes the interior central opening in the flange 34*a* when the closure 20 is in position on opening 18. Thus, the flange 34*a* and plate 34 together form a transverse barrier between that part of the interior of the receptacle 12 accessible via slot 14 and the part thereof containing the principal components of the locking mechanism of the cash safe.

Figure 7:
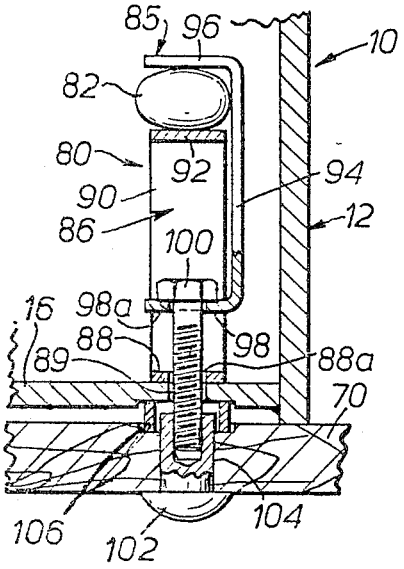
FIG. 7 is a vertical cross-sectional view showing an alternative form of marker device usable in the cash safe of FIG. 1.

The marker device 81 may be replaced by the marker device 80 of FIG. 7. Device 80 includes a first part 86 in the form of an open rectangular frame having a base portion 88 which rests on the upper surface of base plate 16, a pair of opposed upright members of which only one, numbered 90, is visible in the drawings, and an upper transverse portion 92 extending parallel to but spaced well above portion 88. A second part 85 of device 80 is in the form of a generally rectangular plate with upper and lower generally parallel flanges 96, 98 extending from a central upright portion 94, so that in vertical section the part 93 is of the generally U-shaped configuration shown. The parts 86 and 85 are fitted together in the manner shown, that is to say with the flange 96 aligned with and overlying portion 92 of part 86 and with flange 98 overlying and spaced above the portion 88 of part 86.

Flange 98 has an opening 98*a* therein and portion 88 has an aligned opening 88*a* therein. The opening 89 in base plate 16 is in this case aligned with openings 98*a*, 88*a* and a bolt 100 is arranged as shown to extend downwardly through the openings 98*a*, 88*a* and 95 towards bench top 70. A bolt member 102 extends upwardly through an opening 104 in bench top 70. This has an internally threaded bore which receives the threaded shank of bolt 100. A collar 106 is provided around bolt member 102 between bench top 70 and base 16 in order to inhibit severing the connection between the marking device 80 and the bench top 70 by sawing through the bolt member and the bolt. The collar is similar to collars 86 and 91 previously described, and is let into a circular depression in the upper side of bench top 70 and the underside of base plate 16.

A flexible sachet 82 containing dye marker material is located between flange 96 of part 85 and portion 92 of part 86. Screw 100 is screwed down so that the head thereof, which rests upon the upper surface of flange 98, presses downwardly to force the part 85 downwardly to an extent such as to lightly compress the sachet 82. The head of the bolt member 102 then rests against the underside of the bench top 70 so that movement of the part 85 away from the bench top is limited by the co-operative engagement of the bolt member 102 with the bench top 70. Furthermore, in this condition, the part 86 is held engaged against the upper surface of base plate 16 by virtue of downward force exerted from the flange 96, through the sachet 82 to the portion 92 of the part 86.

In the event that unauthorised removal of the cash safe 10 from the bench top 70 should be effected by prying of the cash safe away from the bench top, such as by use of a jimmy between the receptacle 12 and bench top, the part 85 of device 80 remains immovable in the direction away from the bench top 70 by virtue of interconnection provided by the bolt 100 and bolt member 102 as described. However, the part 86, being against the upper surface of base plate 16, will be moved away from the bench top 70 together with the cash safe. Thus, the portion 92 of member 86 will be moved towards flange 96 of part 85 thereby compressing and breaking the sachet 82 to release dye liquid contained therein.

Figure 8:
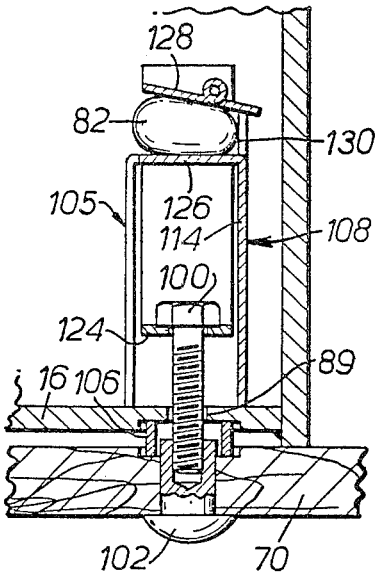
FIG. 8 is a vertical cross-sectional view of another form of marker device usable in the cash safe of FIG. 1.
Figure 9:
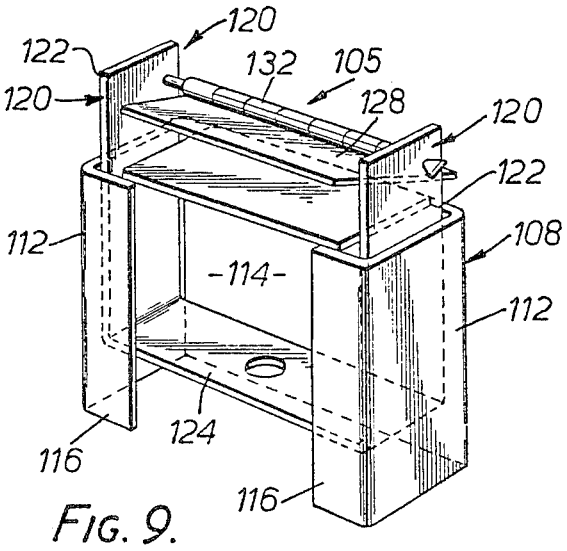
FIG. 9 is a perspective view of the marker device of FIG. 8 with some parts omitted.

A still further form of marker device 105 is shown in FIGS. 8 and 9. This includes a first part 108 of generally channel shaped configuration having an upright web 114 and opposed upright flanges 112. The outer marginal portions 116 of the flanges 112 are inwardly turned towards each other in generally parallel relationship to web 114. A second part 120 of the device 105 is in the form of a "U" shaped frame accommodated within part 108 for up and down sliding movement relative thereto. Part 120 has two upright generally planar arms 122 which lie just within and adjacent to respective ones of the flanges 112. Part 120 also has a generally planar and horizontal base portion 124 which interconnects arms 122. Part 108 is situated on the upper surface of base plate 16 and a bolt 100 extends downward through an aperture in base portion 124 of part 120, through the previously described base plate opening 89 and thence to be secured to bench top 70, again in the same manner as previously described by use of bolt member 102 passing upwardly through the bench top. Sachet 82 is in this instance provided, being positioned on a ledge 126 formed on part 108 at the upper portion thereof. A generally planar lever 128 is positioned above sachet 82. This is supported, towards one edge, on an upright 130 extending from web 114 of part 108. An actuating bar 132 extends across the top portion of part 120, thus extending between and being carried by arms 122. The device 105 is arranged such that by tightening down bolt 100, part 120 is moved downwardly so that bar 132 engages lever 128, at a location adjacent to the edge supported on support 130, to lightly compress the sachet 82 between the lever 128 and ledge 126, thus holding the sachet and locating part 108 firmly against the upper surface of base plate 16.

On prying of the safe from bench top 70, part 120, including bar 132, remains stationary relative to the bench top and part 108 is lifted with the safe so that the lever 128 is pressed upwardly at the location where it is engaged by support 130 to pivot it around bar 132 so compressing that edge of the lever 128 which is located away from support 130 downwardly to effect breakage of the sachet 82.

Figure 11:
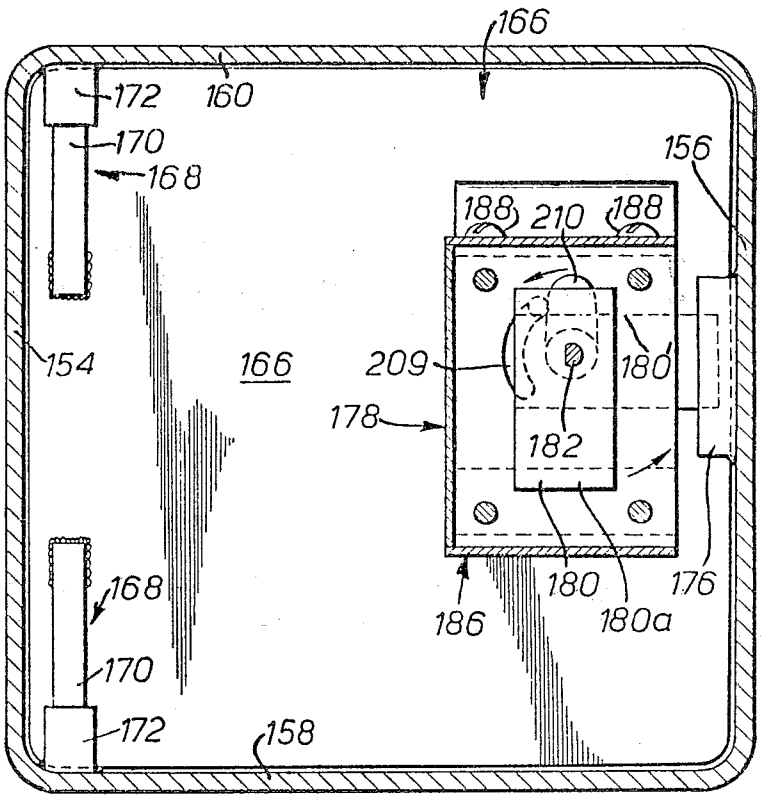
FIG. 11 is a cross-sectional view taken on the line 11—11 in FIG. 10.
Figure 10:
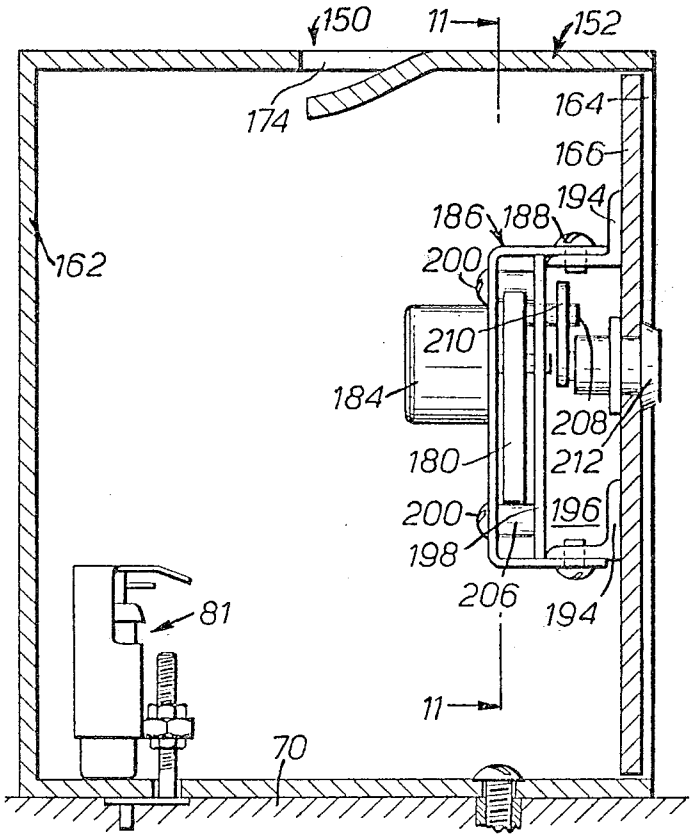
FIG. 10 is a vertical cross-sectional view of an alternative form of cash safe constructed in accordance with this invention.
Figure 12:
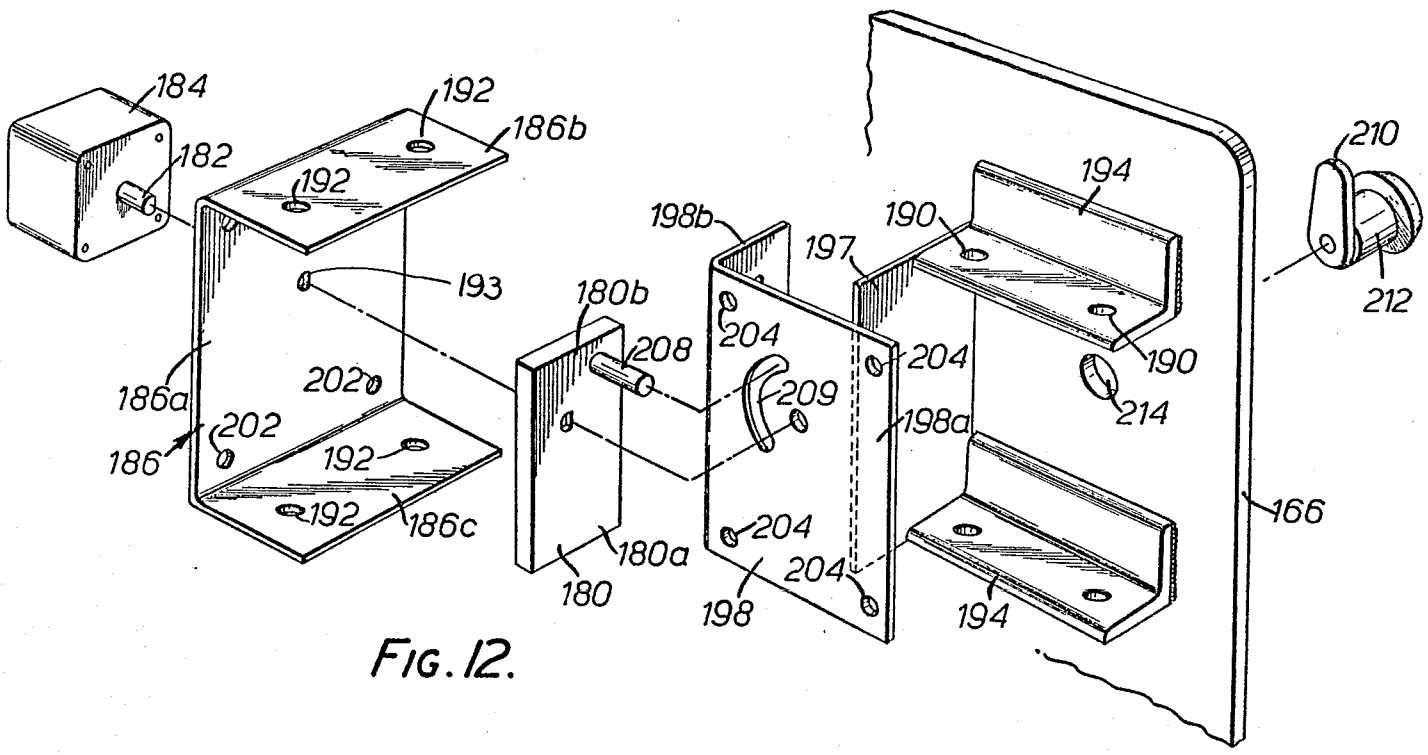
FIG. 12 is an exploded perspective view of components of the cash safe of FIG. 10.

FIGS. 10, 11 and 12 illustrate an alternative form of cash safe 150 formed in accordance with the invention. This includes a generally rectangular receptacle 152, having opposed upright side walls 154, 156, a base 158, a roof 160 and a rear wall 162. The forward end of the safe opposite wall 162 has an opening 164 which is selectively closable by a hinged door 166. Door 166 is of generally rectangular configuration being hinged to one side of opening 164 by hinges 168 each including a hinge pin 170 affixed to the door and engaged within openings in bosses 172 fixed in coaxial aligned relationship to the roof and base of the receptacle 152. A slot 174 is provided in roof 164 for passing money into the interior of the receptacle 152.

In the closed condition of door 166, the door abuts against an abutment 176 welded to side wall 156 opposite hinges 168. A locking means 178 is provided operable to latch the door in this position. Locking means 178 includes a locking member in the form of a pivotal latch member 180 which in the latched condition of the locking means 178 is swung from the position shown in solid lines in FIG. 11 to the position shown by phantom lines 180', at which a free end 180(*a*) of the member 180 is swung to be positioned behind abutment 176 to effect latching.

For the purposes of allowing the member 180 to be swung to and between its latched and unlatched positions, the member 180 is secured intermediate to its ends to the output shaft 182 of a clockwork timer device 184 like previously described timer device 32. Timer device 184 is mounted on an upright web portion 186(*a*) of a channel shaped bracket 186, web portion 186(*a*) being generally parallel to and spaced behind the inner surface of door 166. Bracket 186 is mounted in this position by means of screws 188 which extend through openings 192 in upper and lower flange portions 186(*b*) and 186(*c*) of bracket 186. These screws extend into threaded openings 190 in upper and lower brackets 194 welded to the rear face of door 166.

Bracket 186 defines, together with the rear face of door 166, a cavity 196 which is closed at its forward end by the door 166 and at its rear end by the web portion 186(*a*) of bracket 186. This cavity is also closed at upper and lower edges by the flange portions 186(*b*) and 186(*c*), together with brackets 194. At a side of cavity 196 which is away from side wall 156 when the door 166 is closed, the cavity is also closed by a rearwardly extending plate 197 attached to the rear of the door 166. The cavity is, however, open to the side thereof opposite plate 197.

Timer device 184 is mounted on the rear face of flange portion 186(*a*) with the shaft 182 projecting through an opening 193 in the flange portion into the cavity 196. The latch member 180 is so positioned on shaft 182 as to be within the cavity 196.

An upright partition member 198 is provided within the cavity 196, this having a generally planer upright portion 198*a* which is mounted in generally parallel relationship intermediate door 166 and web portion 186(*a*) of bracket 186 and partition member 198 also has a forwardly extending flange portion 198(*b*) which lies along plate 197. Partition member 198 is located in position by means of screws 200 which extend from the rear of bracket 186 through openings 202 in web portion 186(*a*) and into threaded openings 204 in the planar portion 198(*a*) of partition member 198. The screws 200 pass through collars 206 interposed between the bracket 186 and partition member 198 to maintain these in spaced relationship.

Latching member 180 is positioned between web portion 186(*a*) of bracket 186 and planer portion 198(*a*) of partition member 198. At the end 180(*b*) of member 180 remote from end 180(*a*), latch member 180 is provided with a forwardly projecting pin 208. Pin 208 passes through an arcuate slot 209 in portion 198(*a*) of partition member 198 and the forward end thereof is so positioned as to be selectively engagable by an actuating arm 210 of a cylinder lock 212. Cylinder lock 212 is located in and extends through an opening 214 in door 166 so as to be accessable for key actuation from the exterior of the door, such key actuation causing pivotal movement of arm 210.

In the unlatched condition of the locking means 178, with latch member 180 in the solid line position shown in FIG. 11, the end 180(*a*) of the latch member 180 extends downwardly from the axis of shaft 182 and the end 180(*b*) extends upwardly therefrom. In this position the forward end of pin 208 just rests against one side of arm 210. This position of the arm 210 is arranged to correspond to an unlocked condition of cylinder lock 212. However, on actuation of cylinder lock 212 to bring it to a locked condition, arm 210 is so turned (in the counter-clockwise direction as viewed in FIG. 11) as to bear against pin 208 and turn it, in slot 209, to cause the latch member 180 to be brought to the latched position shown by phantom lines 180 in FIG. 11. During such movement, the shaft 182 of timer device 184 is turned, thus winding up the timer device. If arm 210 is maintained in the moved position, the timer device is held in its wound up condition. Although arm 210 can thereafter be reverted to the position shown in FIG. 11, the pin 208 will not immediately follow this movement, remaining at first in the position to which it was turned. However, as the timer device 184 subsequently unwinds, the shaft 182 will turn in the clockwise direction as viewed in FIG. 11 to eventually turn latch member 180 to revert the pin 208 to its initial position whereupon the door 166 will be unlatched. This unlatching will occur after a time period determined by the extent of initial movement of the shaft 182 and thus by an amount determined by the amount of movement of arm 210 which occurs during locking activation of the cylinder lock 212.

In use, a storekeeper may at the beginning of the day lock the door 166 by inserting the key in cylinder lock 212, turning the key to turn arm 210 and thus to move the latching member 180 to its latched position by movement of pin 208.

As described, by leaving the lock 212 in locked condition with arm 210 in its moved position, the timer device 184 will be precluded from unwinding, by virtue of engagement of the pin 208 against arm 210. During the day, the store keeper may then place money in the receptacle 152 via slot 174. At the end of the day, the storekeeper may, by use of the cylinder lock key, revert the arm 210 to its initial position, whereupon, after the pre-determined time delay caused by timer 184, the shaft 182 will be driven back to its initial position so effecting unlatching to permit retrieval of the money in the receptacle. In this sense, the cash safe 150 is similar to the cash safe 10 except that no provision is made for variable time delays.

The cash safe 150 can be secured to a bench top 70 in the same fashion as described previously in relation to the cash safe 10 and can also be fitted with the marker device 81 (as shown) or the marker device 80 or 105 in the same fashion as cash safe 10.

We claim:

1. A cash safe comprising a hollow safe body having an opening for removal of the contents from the safe, a closure positionable on said receptacle to close said opening, locking means mounted on said closure and actuatable to lock said closure over said opening and deactuatable to unlock said closure, timing means operable in response to actuation of said locking means to preclude deactuation for a time period after said actuation, said locking means comprising a locking member cooperatively connected to said timing means to be rotatable at a predetermined rate by said timing means to move the locking member from an actuated rotational locking position assumed pursuant to said actuation, to a deactuated rotational unlocking position, abutment means on said safe body, said locking member co-operating with said abutment means when at a rotational position other than said deactuated position to lock said closure, and, when at said deactuated position, to unlock said closure, said timing means comprising a clock timer having an actuating member and actuated by rotation of said actuating member in a predetermined direction to a predetermined extent, and subsequently operating to rotate said actuating member in the direction opposite to said predetermined direction at said predetermined rate whereby said time period is dependent upon said predetermined extent to which said actuating member is rotated, and means selectively operable to, in one position, interrupt operation of said timing means and in another position to release said interruption of operation and restore the timing means to operation.

2. A cash safe as claimed in claim 1 wherein said closure further comprises a setting member projecting from that side of said closure which is external to the cash safe when the closure is in position over said opening and which is operable to move said actuating member to said predetermined extent.

3. A cash safe as claimed in claim 2 wherein said setting member is interconnected with said locking member by a lost motion linkage so that movement of said setting member in a first rotational direction from a rest position causes said locking member to be moved from said deactuated position to a said actuated position, and said setting member cannot by subsequent movement thereof be caused to move the locking member in the direction towards said deactuated position.

4. A cash safe as claimed in claim 3 wherein said setting member comprises a knob rotatably mounted in said closure, and said lost motion linkage comprises a rotatable member connected to said knob for rotation therewith, a first abutment on said rotating member, and a second abutment on said locking member cooperatively engaging said first abutment for imparting movement to said locking member from the setting member in a direction for moving the locking member away from said deactuated position, but cleared from said engagement by reverse rotational movement of the setting member.

5. A cash safe as claimed in claim 4 wherein said means to interrupt said timing means comprises releasable latch means for latching the locking member when positioned at a said actuated position, to inhibit operation of said timing means and rotation of the locking member back to said deactuated position.

6. A cash safe as claimed in claim 5 wherein said latch means comprises a latch member mounted on said closure and operable to releasably engage said rotatable member to effect latching thereof against rotation to preclude rotation of the locking member back towards said deactuated position.

7. A cash safe as claimed in claim 6 and further comprising a key actuatable device operably mounted on said closure in engagement with said latch member and accessible to actuation when the closure member is positioned on said opening.

8. A cash safe as claimed in claim 7 wherein said rotatable member is in the form of a disc and said latch means comprises a toothed peripheral portion on said disc cooperatively engageable with said latching member, said latch member being operated by said key actuatable device to selectively engage the teeth of said toothed peripheral portion.

9. A cash safe as claimed in claim 8 wherein said locking member has one or more radially outwardly extending projections and said abutment means on said safe body comprises a radially inwardly extending ledge around said opening with circumferentially spaced openings therein aligned with respective ones of the said outwardly extending projections to facilitate passage therethrough of said projections.

10. A cash safe as claimed in claim 9 wherein said closure is provided with means to preclude rotation thereof relative to the said ledge when in the closed position comprising, abutments on said closure cooperatively engaging in said spaced openings in said ledge.

11. A cash safe as claimed in claim 1 and further comprising an opening in said safe body for admission of said cash thereinto, but being dimensioned to at least substantially preclude removal of said cash.

12. A cash safe as claimed in claim 1 and further comprising a rotatable key lock mounted on and extending through said closure for actuation from the exterior of the safe, an operating member mounted on the inner end of said key lock for rotation therewith and cooperatively engaging said locking member to move from an initial position and correspondingly move said locking member from said deactuated position to said actuated position to effect locking, and to effect said rotation of said actuating member in said predetermined direction to said predetermined extent, and to hold said actuating member against reverse movement until the key lock is actuated to bring the operating member back to its initial position whereafter said locking member is moved by said timing means to return said locking member to the deactuated position after said time period, to release said locking.

13. A cash safe as claimed in claim 1 wherein said locking means is adapted for automatic deactuation by said timing means after said time period.

14. A cash safe as claimed in claim 13 wherein said timing means includes means by which said time period is variable and pre-selectable.

15. A cash safe having an anti-burglar marker device comprising a hollow safe having a base, means to secure said safe by the base to a rigid member, a receptacle within said safe containing dye material, said receptacle being operable to release said dye material upon predetermined compression of said receptacle, and means to compress said receptacle comprising a first part disposed on one side of said receptacle, an opening through said base, said first part having a portion extending through said opening, means to secure said extending portion to said rigid member so that said first part is fixed in position with respect to said rigid member, and a second part positioned on the side of said receptacle substantially opposite to said first part and movable with respect to said first part in a direction substantially toward said receptacle upon displacement of said safe in a direction away from said rigid member, so that said relative movement between said first and second parts compresses said receptacle beyond said predetermined compression to cause said receptacle to release said dye material to mark the contents of the safe.

16. A cash safe as claimed in claim 15 wherein said second part comprises an interior surface of the cash safe.

* * * * *